US011585625B2

(12) United States Patent
Schwieger et al.

(10) Patent No.: US 11,585,625 B2
(45) Date of Patent: Feb. 21, 2023

(54) GUN BARREL MOUNTING AND GUN

(71) Applicant: Rheinmetall Waffe Munition GmbH, Unterlüß (DE)

(72) Inventors: Florian Schwieger, Unterlüß (DE); Berthold Baumann, Unterlüß (DE); Rüdiger Borchert, Unterlüß (DE)

(73) Assignee: RHEINMETALL WAFFE MUNITION GMBH, Unterlüß (DE)

( * ) Notice: Subject to any disclaimer, the term of this patent is extended or adjusted under 35 U.S.C. 154(b) by 44 days.

(21) Appl. No.: 17/422,233

(22) PCT Filed: Dec. 12, 2019

(86) PCT No.: PCT/EP2019/084795
§ 371 (c)(1),
(2) Date: Jul. 12, 2021

(87) PCT Pub. No.: WO2020/143985
PCT Pub. Date: Jul. 16, 2020

(65) Prior Publication Data

US 2022/0074697 A1 Mar. 10, 2022

(30) Foreign Application Priority Data

Jan. 11, 2019 (DE) ..... 10 2019 100 579.5

(51) Int. Cl.
*F41A 25/00* (2006.01)
*F41A 25/22* (2006.01)

(52) U.S. Cl.
CPC ..... *F41A 25/00* (2013.01); *F41A 25/22* (2013.01)

(58) Field of Classification Search
CPC ..... F41A 25/00; F41A 25/22; F41A 25/24; F41F 1/00
See application file for complete search history.

(56) References Cited

U.S. PATENT DOCUMENTS 2,454,818 A * 11/1948 Lucht ..... F41A 25/18 89/44.01
2,851,809 A 9/1958 Colby
4,483,235 A 11/1984 Hallqvist
4,638,714 A * 1/1987 Heintz ..... F41A 27/08 89/37.14
5,544,564 A * 8/1996 Balbo ..... F41A 25/00 42/75.02

(Continued)

FOREIGN PATENT DOCUMENTS

CN 103868402 A 6/2014
DE 1 037 925 B 8/1958

(Continued)

OTHER PUBLICATIONS

International Search Report from corresponding PCT Application No. PCT/EP2019/084795, dated Feb. 5, 2020.

(Continued)

*Primary Examiner* — Gabriel J. Klein
(74) *Attorney, Agent, or Firm* — Harness, Dickey & Pierce, P.L.C.

(57) ABSTRACT

The invention relates to a gun barrel mounting for a gun barrel, comprising a cradle with at least one gun mounting for mounting the gun barrel and a base part that can be connected to the gun barrel.

12 Claims, 5 Drawing Sheets

(56) References Cited

U.S. PATENT DOCUMENTS

| | | | | |
|---|---|---|---|---|
| 2004/0020352 | A1* | 2/2004 | Knorich | F41A 25/00 89/19 |

FOREIGN PATENT DOCUMENTS

| | | | | |
|---|---|---|---|---|
| DE | 31 48 265 | A1 | 6/1983 | |
| DE | 19800193 | A1 * | 7/1999 | F41A 25/00 |
| DE | 101 46 423 | A1 | 4/2003 | |
| DE | 102 26 534 | A1 | 1/2004 | |
| EP | 1371930 | A2 | 12/2003 | |
| FR | 3109816 | A1 * | 11/2021 | |
| GB | 2237622 | A | 5/1991 | |

OTHER PUBLICATIONS

Written Opinion & Search Report from corresponding Singapore Application No. 11202107601U, dated Dec. 9, 2022.

* cited by examiner

GUN BARREL MOUNTING AND GUN

CROSS-REFERENCE TO RELATED APPLICATIONS

This application is a national phase application of PCT Application No. PCT/EP2019/084795, filed on 12 Dec. 2019, which claims priority to and benefit of German Patent Application No. 10 2019 100 579.5, filed on 11 Jan. 2019. The entire disclosures of the applications identified in this paragraph are incorporated herein by references.

FIELD

The invention relates to a gun barrel mounting for a gun barrel, in particular of a large-caliber weapon, comprising a cradle with at least one barrel mounting for supporting the gun barrel and a breech end that can be connected to the gun barrel.

The application further relates to a gun, in particular a large-caliber weapon, comprising at least one gun barrel mounting of this kind and at least one gun barrel connected to the breech end.

BACKGROUND

A gun barrel is traditionally mounted in a cradle, in order to allow the breech and barrel to move backwards. The mounting is customarily configured as a plain bearing bush. This mounting should be designed with as little clearance as possible, so that a high degree of precision can be achieved for the weapons system. However, a small amount of bearing clearance is necessary due to thermal expansion and the expansion of the gun barrel resulting from the internal pressure that occurs during firing. This bearing clearance means that the barrel usually only rests on the bearing with the underside of the barrel under its own weight. When firing takes place, the barrel expands under the gas pressure. The midpoint of the barrel in this case performs a lifting movement in a vertical direction. This lifting movement stimulates vibrations in the barrel and has a negative impact on the precision of the weapons system.

A mounting for a large-caliber weapon which supports the weapon barrel in two slide bushes arranged at the muzzle and breech end of a cradle tube is known from DE 31 48 265 A1. With a slide-bush mounting of this kind, in which the barrel rests on the lower bearing inner edge in a mass-induced manner, the gun barrel is lifted by the barrel widening that occurs during firing. This leads to vibrations in the gun barrel and has a negative impact on the hit accuracy of the projectile in each case.

In order to avoid the barrel vibrations which occur in a large-caliber barrel during firing, DE 39 36 454 A1 discloses the use of bearings which are free from the lifting effect, in which the gun barrel does not strike a fixed abutment in a radial direction during firing, instead of traditional slide-bush bearings, so that barrel widening can take place both in a horizontal and vertical direction. For the mounting of the gun barrel in the cradle tube, four evenly distributed guide rails are provided on the circumference of said gun barrel which extend in the direction of the longitudinal axis and are configured as slide rails, said guide rails engaging with corresponding guide grooves in the cradle tube in such a manner that the directions of the bearing force and the radial barrel widening are each perpendicular to one another. The principle disadvantage of this mounting is that the guide rails and guide grooves extend away on the gun barrel over the entire length of the cradle tube, so that a large amount of engineering is required. In larger weapons systems, the guide elements are provided at least sectionally in the front and rear regions, or in multiple regions. Changing the gun barrel is time-consuming with guns of this kind and the outer diameter of the cradle is relatively large due to the use of a mounting of this kind.

A gun with a lifting effect-free mounting of a large-caliber gun barrel in a cradle tube is known from DE 31 50 250 A1. Four guide rails are arranged in this case too; however they are not configured as slide bearings, but as anti-friction bearings, wherein the bearing faces of the guide rails are supported on the corresponding bearing faces of the cradle tube via anti-friction bearings which are guided through flat cages when the barrel travels backwards. DE 31 50 250 A1 envisages a disadvantage of the prior art on which this application is based as being that only slide bearings are used for the longitudinally displaceable guidance of large-caliber gun barrels, which slide bearings require an exceptionally large bearing clearance to prevent them from jamming. However, this bearing clearance in turn has a negative effect on the hit accuracy. To solve this problem, it is therefore proposed that instead of the slide bearing, anti-friction bearings should likewise be incorporated, so that the gun barrel is not only guided entirely without clearance, but also works in an entirely slip-free and wear-free manner.

DE 31 48 265 A1 is likewise based on a mounting of a backwards and forwards-moving, large-caliber gun barrel by means of two plain bearing bushes as the prior art, and establishes that as a consequence of a plain bearing clearance that has to be observed in this case, the hit accuracy is detrimentally affected by uncontrolled transverse barrel movements. This problem is solved in that the gun barrel is supported within two bearings arranged in the cradle tube in a clearance-free manner.

A centered gun barrel front bearing for large-caliber weapons which supports the gun barrel in the region of the cradle tube at the breech end with a slide bush bearing known per se with an existing fit clearance specification is known from DE 198 00 193 A1.

A further central barrel mounting for large-caliber weapons is described in DE 102 26 534 A1. The gun barrel is supported therein in a first slide bush bearing arranged at the muzzle end of the cradle tube and in a second slide bush bearing arranged at the breech end of the cradle tube. The first slide bush bearing has a lifting effect-free design and comprises a barrel bush, the outer surface of which is slidingly supported in the cradle tube. The barrel bush in each case has on the inside at least three groove-shaped recesses evenly distributed over the circumference, with which recesses at least three strip-shaped projections of the gun barrel engage. Between the outer surface of the gun barrel, or of an inner ring which supports the strip-shaped projections and is connected to said gun barrel in a form-fitting manner, and the inner surface of the barrel bush, and also between the strip tops and the inner surface of the groove-shaped recesses of the barrel bush, a predefined clearance is provided in such a manner that the widening of the gun barrel which occurs during firing lies within said clearance.

SUMMARY

The solutions already known in the art involve high manufacturing expenditure and in some cases require a large amount of installation space. In addition, in the case of solutions involving rail systems, the barrel change is very time-consuming.

On this basis, the problem addressed by the invention is that of creating a gun barrel mounting which allows the barrel lifting movement to be reduced, and does not have a negative impact on the changing of the gun barrel.

This problem is solved by the gun barrel mounting in claim 1. Furthermore, this problem is solved by the gun in claim 10. Advantageous embodiments and developments are the subject-matter of the dependent claims in each case.

According to the invention, a gun barrel mounting for a gun barrel is provided which comprises a cradle with at least one barrel mounting, preferably two barrel mountings, for supporting the gun barrel and a breech ring ("breech end") that can be connected to the gun barrel. The cradle and the breech end are connected to one another in a separable manner by at least one guide radially supporting the breech end.

Furthermore, a gun comprising at least one gun barrel mounting of this kind, or one developed as described below, and at least one gun barrel connected to the breech end, is provided according to the invention.

Consequently, a gun barrel mounting which comprises a cradle that is connected to the breech end via at least one guide is provided according to the invention. The breech end can, in turn, be connected to the gun barrel. It is achieved that the gun barrel is held in position by the breech end and said breech end can be positioned relative to the cradle by means of the guide. It is thereby achieved that, particularly in the region of the chamber, the gun barrel no longer rests on the cradle or a rear barrel mounting, but has a clearance in respect of the barrel mounting, at least at the moment the shot is fired. A substantial reduction in the barrel lifting movement which occurs due to the barrel widening is achieved. A support of the gun barrel and the rear barrel mounting is avoided according to the invention, particularly in the region of the chamber in which the gun barrel has a smaller wall thickness and the barrel widening is particularly great as a result. Instead of the entire gun barrel being guided on rails, as in the solutions known in the prior art, the gun barrel is preferably only guided until the projectile has left the backwards-moving gun barrel. Since the gun barrel is supported via the breech end in the gun according to the invention, the lifting movement of the barrel is also substantially smaller.

By means of the embodiment according to the invention, the manufacturing cost is also reduced compared with the existing solutions. Furthermore, substantially less installation space is required and a barrel change is not hindered by guide rails and the like. In addition, the design of the gun barrel mounting is not unnecessarily complicated.

The cradle and breech end are connected to one another in a separable manner by the radially supporting guide. In other words, the cradle and breech end are movable in respect of one another, but are supported in a radial direction. The radial direction is a radial direction of the at least one barrel mounting, preferably of the rear barrel mounting, and also a radial direction of the gun barrel.

In an advantageous development, it may be provided that the cradle and the breech end are movably connected in an axial direction by the at least one guide. It is thereby achieved that the backwards-moving mass can move axially in respect of the cradle.

The axial direction is defined by the center line of the gun barrel and/or the at least one barrel mounting.

In a development, it may be provided that the guide is positioned in a radial direction of the at least one barrel mounting, the cradle, and the breech end in respect of one another.

The fact that the cradle and the breech end are positioned relative to one another means that the breech end, and a gun barrel that can be connected thereto, is raised in respect of the cradle and a rear barrel mounting. A uniform clearance is formed about the gun barrel between said gun barrel and the rear barrel mounting. The gun barrel can therefore extend radially in an unhindered manner during firing. The greatest barrel widening occurs in the region of the chamber of the gun barrel, since the internal pressure in the gun barrel during firing is greatest there and the wall thickness is reduced. The rear barrel mounting is preferably arranged in this region, so that there is a clearance between the rear barrel mounting and the gun barrel where the widening of the gun barrel is greatest.

It can preferably be provided that the guide is fastened to the cradle and is movable along with said cradle in an axial direction of the gun barrel relative to the breech end. As a possible alternative to this, it may be provided that the guide is fastened to the breech end and is movable along with said breech end in an axial direction of the gun barrel relative to the cradle.

An embodiment of the gun barrel mounting may provide that the guide comprises two guide elements and two correspondingly shaped recesses for the movable receiving of one side of the guide elements in the cradle or in the breech end.

In addition, it may be provided that the position of the two guide elements is adjustable in an up/down direction.

Furthermore, it may be provided in a development that the position of one guide element is adjustable in a right/left direction, and the other holding element exhibits a clearance in the right/left direction in at least one of the recesses.

Furthermore, the gun barrel mounting may provide that the guide has a guide piece for supporting the breech end arranged beneath the cradle. The guide piece is preferably adapted to the shape of the breech end for this purpose.

In addition, an embodiment of the gun barrel mounting may provide that the cradle has a pressing device, in particular a spring-loaded cam, which prestresses the breech end in respect of the guide. In this way, unwanted tilting of the breech end and gun barrel in respect of the cradle is prevented.

A development of the gun barrel may provide that the guide positions the breech end and the cradle radially in respect of one another, in such a manner that a radial clearance between the gun barrel and a rear barrel mounting is formed.

The fact that the cradle and breech end are positioned relative to one another means that the gun barrel is raised in respect of the cradle and a rear barrel mounting. A uniform clearance is formed around the gun barrel between said gun barrel and the rear barrel mounting. The gun barrel can therefore extend radially in an unhindered fashion during firing. The greatest barrel widening occurs in the region of the chamber of the gun barrel, since the internal pressure in the gun barrel during firing is greatest there and the wall thickness is reduced. The rear barrel mounting is preferably arranged in this region, so that there is a clearance between said rear barrel mounting and the gun barrel where the widening of the gun barrel is greatest.

In addition, a development of the gun barrel may provide that a radially supporting length of the guide is at least as great as the backwards-moving path of a backwards-moving mass, until a fired projectile has left the gun barrel. The backwards-moving mass preferably comprises at least the gun barrel and the breech end.

It is thereby achieved that, at least until the projectile has left the gun barrel, there is a clearance between the gun barrel and the rear barrel bearing, as a result of which a barrel lifting movement is avoided. It is possible that for a part of the backwards-moving path, the guide is no longer in contact with the cradle and the breech end. During a subsequent forwards movement of the backwards-moving mass, the guide is once again centered by centering or aligning means, in such a manner that the backwards-moving mass returns to its starting position. Hence, for example, a guide arranged on the cradle can be projected into the breech end again. Equally, a guide arranged at the breech end can be projected into the cradle again.

BRIEF DESCRIPTION OF THE DRAWINGS

The invention is to be explained in greater detail below with reference to the drawings with the help of exemplary embodiments.

In the drawings.

DETAILED DESCRIPTION

Figure 1:
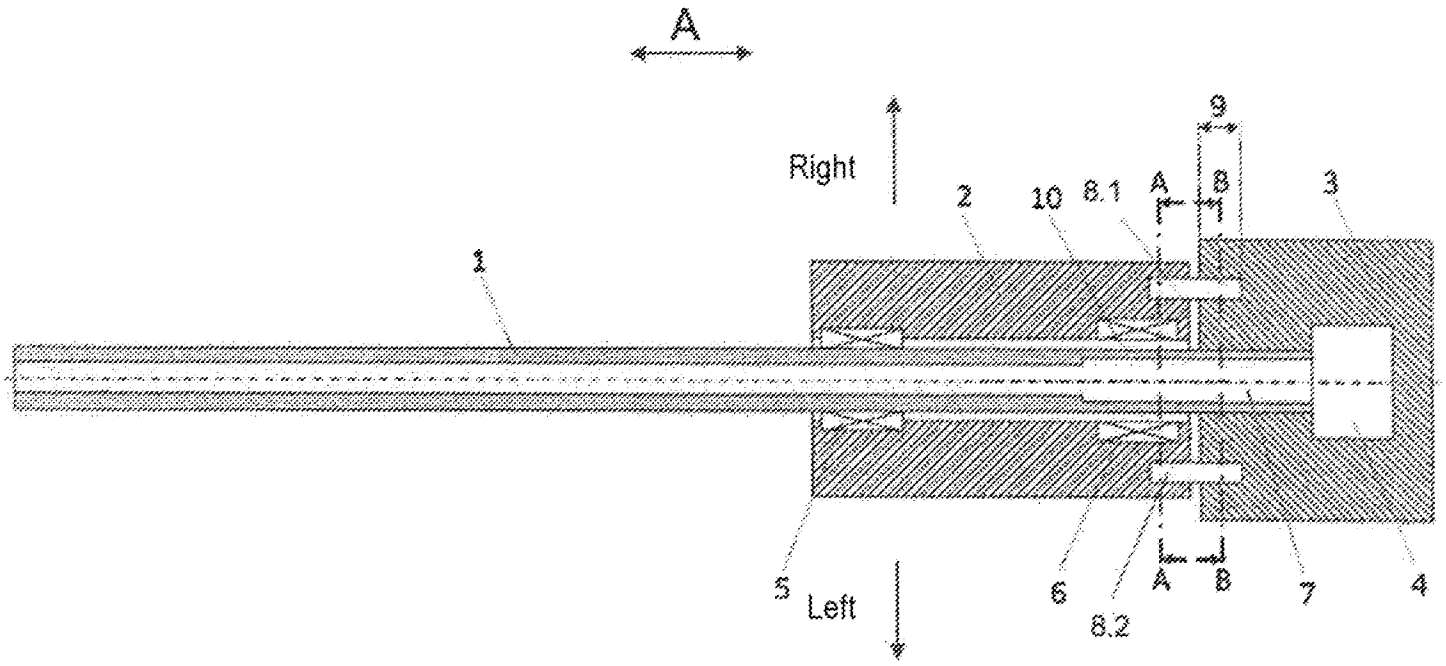
FIG. 1 shows a schematic side view as a sectional representation of a gun with a gun barrel mounting according to the invention as an embodiment.

FIG. 1 shows a schematic side view as a sectional representation of a gun having a gun barrel mounting according to the invention as an embodiment, wherein the following disclosure relates both to the gun with the gun barrel mounting, and also to the gun barrel mounting per se without the gun. The gun barrel mounting has a cradle 2 and two barrel mountings 5, 6 to support a gun barrel 1. A front barrel mounting 5 is arranged in the front region of the cradle 2, and a rear barrel mounting 6 in a rear region of the cradle 2. In addition, the gun barrel mounting has a breech end 3 which can be connected to the gun barrel 1. The cradle 2 and the breech end 3 are connected to one another in a separable manner by at least one guide 8.1, 8.2 radially supporting the breech end 3. Furthermore, the cradle 2 and the breech end 3 are movably connected by the at least one guide 8.1, 8.2 in an axial direction A.

The guide 8.1, 8.2 positions the cradle 2 and the breech end 3 radially in relation to one another in a radial direction of the rear barrel mounting 6, which may also be a radial direction of the gun barrel 1, in such a manner that a radial clearance 10 is formed between the gun barrel 1 and a rear barrel mounting 6.

The guide 8.1, 8.2 is configured in such a manner that it positions the cradle and the breech end 3 in relation to one another in a radial direction of the rear barrel mounting 6, in particular in an up/down direction. The guide 8.1, 8.2 has at least two holding elements 15.1, 15.2 which engage with two recesses 16.1, 16.2. The part of the holding elements 15.1, 15.2 which engages with the recesses 16.1 and 16.2 forms a radially supporting length 9 of the guide 8.1, 8.2. The radially supporting length 9 of the guide 8.1, 8.2 is at least as large as the backwards-moving path of a backwards-moving mass, until a fired projectile has left the gun barrel 1. The backwards-moving mass at least comprises the gun barrel 1 and the breech end 3.

The holding elements 15.1 and 15.2 are fastened to the cradle 2. For this purpose, notches 14.1, 14.2 are formed in the cradle, in which the holding elements 15.1, 15.2 are fixed. The holding elements 15.1, 15.2 can be moved along with the cradle 2 in the axial direction of the gun barrel 1 relative to the breech end 3. For this purpose, the recesses 16.1, 16.2 are formed in the breech end 3.

Figure 2:
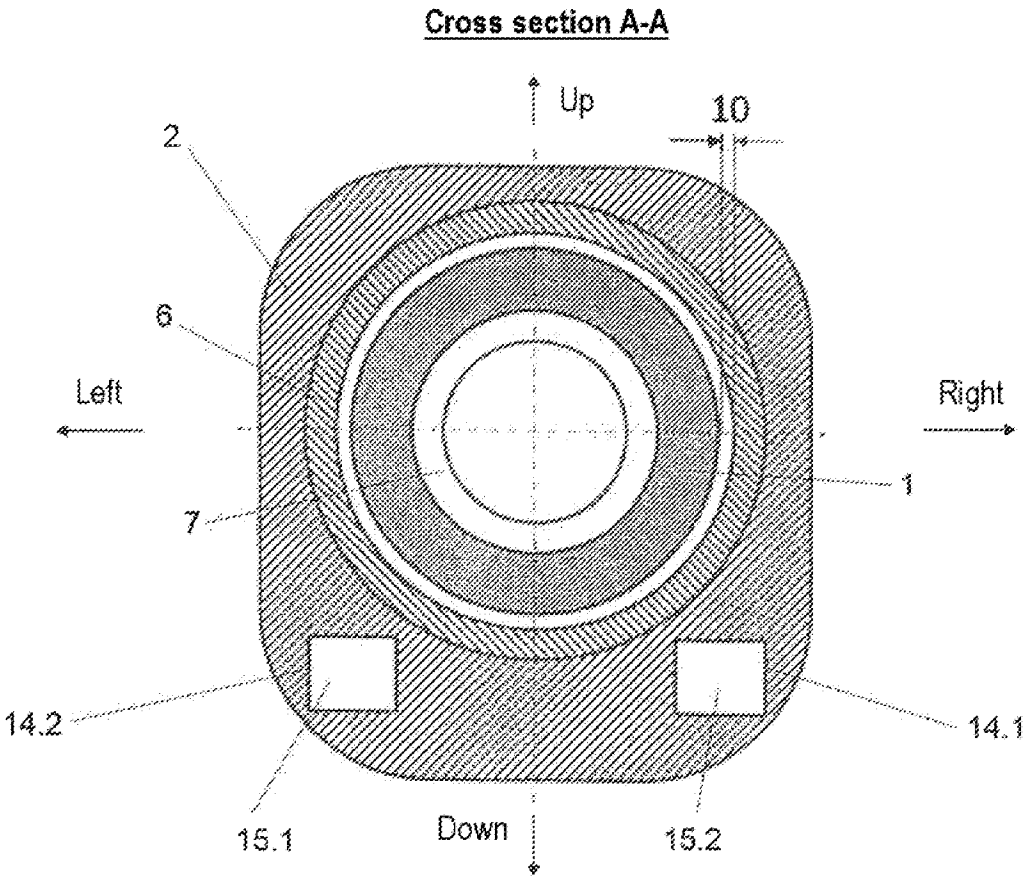
FIG. 2 shows a schematic sectional representation along the cross section A-A in FIG. 1.

FIG. 2 shows a schematic sectional representation along the cross section A-A in FIG. 1. The cross section A-A runs through the cradle 2 in the region of the rear barrel mounting 6. The rear barrel mounting 6 is arranged within the cradle 2. A clearance 10 is formed between the gun barrel 1 and the rear barrel mounting 6. Within the gun barrel 1 along the cross section A-A, a chamber 7 of the gun barrel 1 that can be closed by a breech wedge 4 is formed. In order to fix the two holding elements 15.1, 15.2, two correspondingly shaped notches 14.1, 14.2 are formed in the cradle 2.

Figure 3:
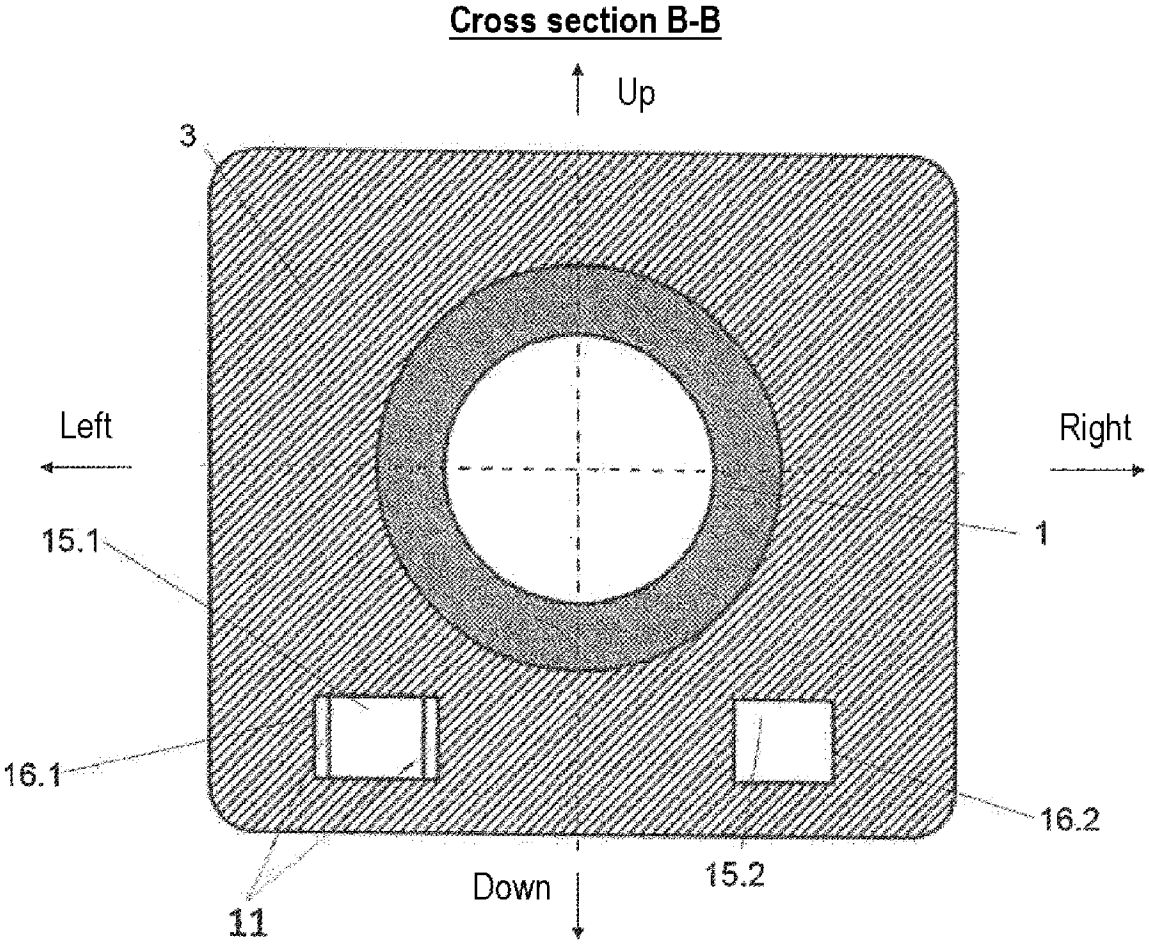
FIG. 3 shows a schematic sectional representation along the cross section B-B in FIG. 1.

FIG. 3 shows a schematic sectional representation along the cross section B-B in FIG. 1. The cross section runs through the breech end 3 in the region of the guides 8.1, 8.2. As can be seen from FIG. 3, the weapon barrel 1 is fixed in the breech end 3. Recesses 16.1, 16.2 are formed within the breech end 3. The recesses 16.1, 16.2 are used for the movable receiving of the holding elements 15.1, 15.2. The position of the two holding elements 15.1, 15.2 can be adjusted in an up/down direction. The position of one holding element 15.2 can be adjusted in a left/right direction and the other holding element 15.1 has a clearance 11 in the right/left direction in at least one of the recesses 16.1. The directions are identified by corresponding direction arrows in the figures.

Figure 4:
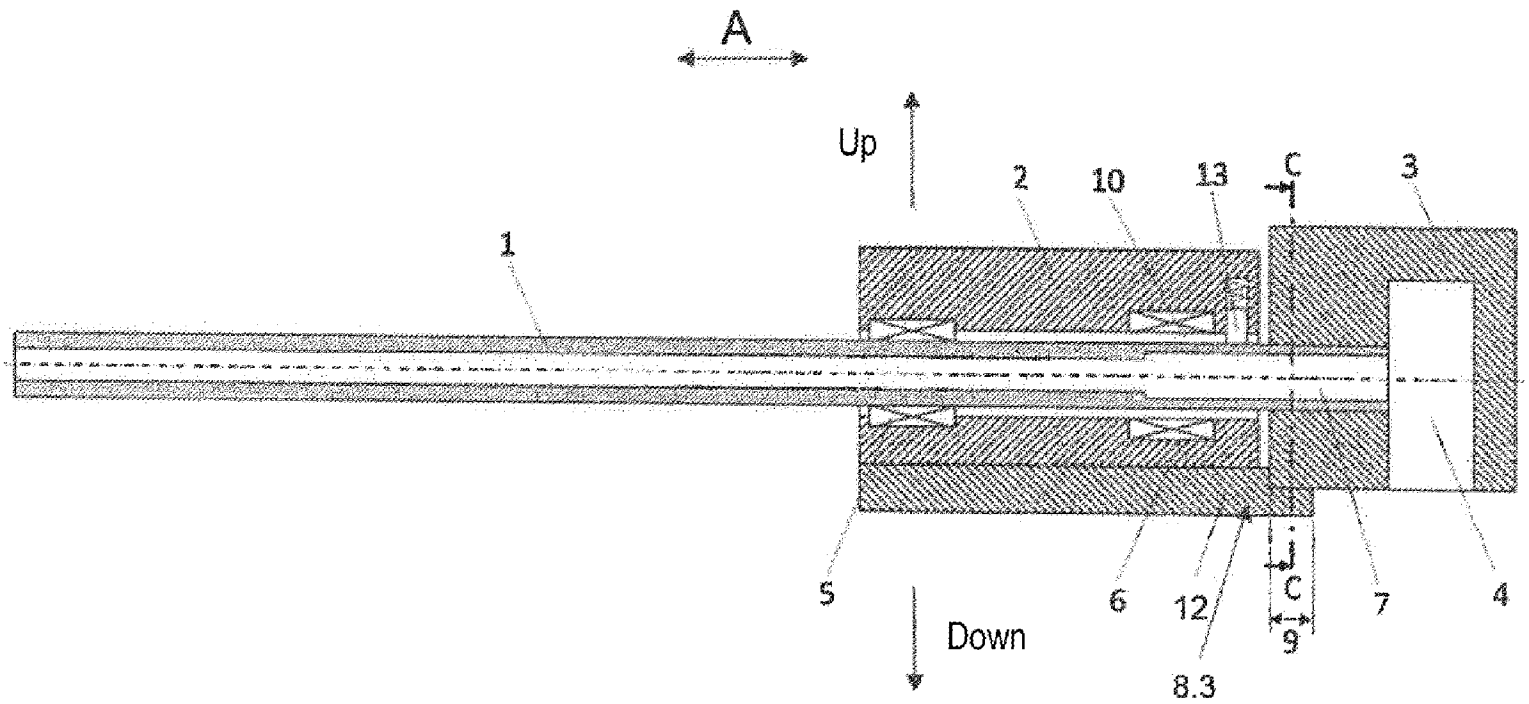
FIG. 4 shows a schematic side view as a sectional representation of a gun with a gun barrel mounting according to the invention as a further embodiment.

FIG. 4 shows a schematic side view as a sectional representation of a gun barrel mounting according to the invention as a further embodiment. The embodiment is based on the embodiment according to FIGS. 1 to 3, wherein the differences in embodiments are set out below. The guide 8.3 is configured in accordance with the embodiment depicted in FIG. 4 as a guide piece 12 arranged below the cradle 2 for supporting the breech end 3. The guide piece 12 is configured along the axial length of the cradle 2. In addition, a pressing device 13 is configured which comprises a spring-loaded cam which prestresses the breech end 3 in respect of the guide 8.1, 8.2, 8.3. The guide piece 12 and the pressing device 13 position the cradle 2 and the breech end 3 radially to one another, in such a manner that a radial clearance 10 is formed between the gun barrel 1 and the rear barrel mounting 6.

The guide 8.3 is configured in such a manner that the breech end 3, along with the gun barrel 1, is movable in an axial direction A relative to the cradle 2. The guide piece 12 forms a radially supporting length of the guide 8.3 which is at least as great as the backwards-moving path 9 of the backwards-moving mass, until a fired projectile has left the gun barrel 1.

Figure 5:
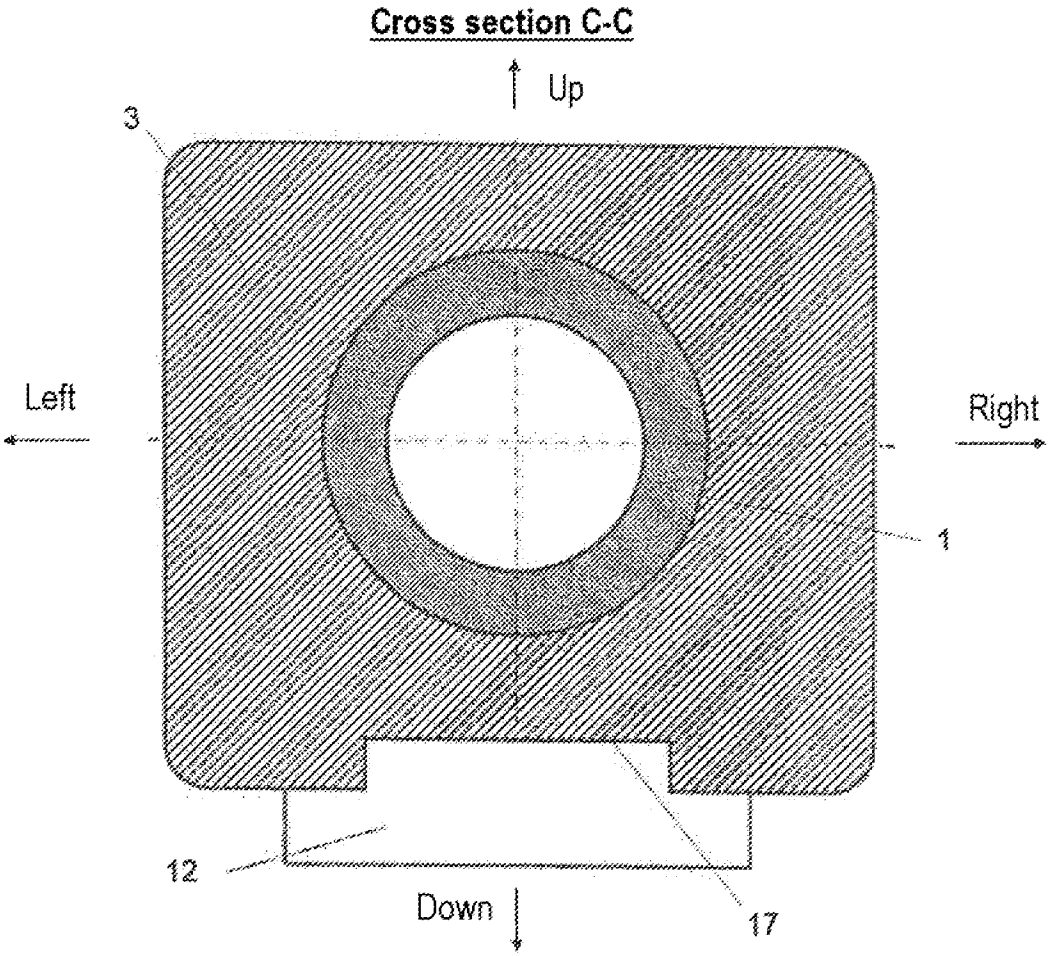
FIG. 5 shows a schematic sectional representation along the cross section C-C in FIG. 4.

FIG. 5 shows a schematic sectional depiction along the cross section C-C in FIG. 4. The cross section runs through the breech end 3 in the region of the guide piece 12. As can be seen from FIG. 5, the gun barrel 1 is fixed in the breech end 3. A groove 17 is formed within the breech end 3 which corresponds to the shape of the guide piece 12. The groove 17 is used for the movable receiving of the guide piece 12.

LIST OF REFERENCE NUMBERS

1 gun barrel
2 cradle
3 breech end
4 breech wedge
5 front barrel mounting
6 rear barrel mounting
7 chamber
8.1, 8.2, 8.3 guide
9 radially supporting length
10 radial clearance
11 clearance in right/left direction
12 guide piece
13 pressing device
14.1, 14.2 notches
15.1, 15.2 guide elements
16.1, 16.2 recesses
17 groove

What is claimed is:

1. A gun barrel mounting for a gun barrel, comprising:

a cradle including at least one barrel mounting for supporting the gun barrel, and a breech ring connectable to the gun barrel, wherein the cradle and the breech ring are connected to one another in a separable manner by at least one guide radially supporting the breech ring, and wherein the cradle includes a pressing device configured to prestress the breech ring in respect of the at least one guide.

2. The gun barrel mounting as claimed in claim 1, wherein the cradle and the breech ring are movably connected in an axial direction by the at least one guide.

3. The gun barrel mounting as claimed in claim 1, wherein the guide positions the cradle and the breech ring in respect of one another in a radial direction of the barrel mounting.

4. The gun barrel mounting as claimed in claim 1, wherein the guide is fastened to the cradle and is movable along with said cradle in an axial direction relative to the breech ring or the guide is fastened to the breech end and is movable along with the breech ring in an axial direction relative to the cradle.

5. The gun barrel mounting as claimed in claim 1, wherein the guide comprises two guide elements and two correspondingly formed recesses for the movable receiving of one side of the guide elements in the cradle or in the breech ring.

6. The gun barrel mounting as claimed in claim 5, wherein the position of the two guide elements is adjustable in an up/down direction.

7. The gun barrel mounting as claimed in claim 6, wherein the position of one of the guide elements is adjustable in a right/left direction, and the other guide element exhibits a clearance in the right/left direction in at least one of the recesses.

8. The gun barrel mounting as claimed in claim 1, wherein the guide has a guide piece for supporting the breech ring arranged beneath the cradle.

9. The gun barrel mounting as claimed in claim 1, wherein the pressing device includes a spring-loaded cam.

10. A gun comprising at least one gun barrel mounting as claimed in claim 1, and at least one gun barrel connected to the breech ring.

11. The gun as claimed in claim 10, wherein the guide positions the breech ring and the cradle radially in relation to one another in such a manner that a radial clearance is formed between the gun barrel and a rear barrel mounting.

12. The gun as claimed in claim 11, wherein a radially supporting length of the guide is at least as great as the backwards-moving path of a backwards-moving mass, until a fired projectile has left the gun barrel.

* * * * *